US007803068B2

(12) United States Patent
Clausen et al.

(10) Patent No.: US 7,803,068 B2
(45) Date of Patent: Sep. 28, 2010

(54) CAVITY BACK GOLF CLUB HEAD

(75) Inventors: Karl A. Clausen, San Marcos, CA (US); Ryan Lo, Carlsbad, CA (US); Thomas C. Morris, Carlsbad, CA (US)

(73) Assignee: Cobra Golf, Inc., Carlsbad, CA (US)

( * ) Notice: Subject to any disclaimer, the term of this patent is extended or adjusted under 35 U.S.C. 154(b) by 212 days.

(21) Appl. No.: 11/766,824

(22) Filed: Jun. 22, 2007

(65) Prior Publication Data

US 2008/0318708 A1 Dec. 25, 2008

(51) Int. Cl.
*A63B 53/00* (2006.01)

(52) U.S. Cl. ..... 473/350; 473/331; 473/332; 473/342

(58) Field of Classification Search ..... 473/324–350, 473/287–292
See application file for complete search history.

(56) References Cited

U.S. PATENT DOCUMENTS

| | | | | |
|---|---|---|---|---|
| 4,740,345 | A | 4/1988 | Nagasaki et al. | |
| 4,964,640 | A | 10/1990 | Nakanishi et al. | |
| 5,277,423 | A | 1/1994 | Artus | |
| 5,290,036 | A | 3/1994 | Fenton et al. | |
| 5,316,298 | A | 5/1994 | Hutin et al. | |
| 5,697,855 | A * | 12/1997 | Aizawa | 473/350 |
| 6,080,069 | A | 6/2000 | Long | |
| 6,273,831 | B1 | 8/2001 | Dewanjee | |
| 6,835,144 | B2 | 12/2004 | Best | |
| 6,902,495 | B2 * | 6/2005 | Pergande et al. | 473/332 |
| 6,921,343 | B2 | 7/2005 | Solheim | |
| 6,942,586 | B2 | 9/2005 | Falone et al. | |
| 6,951,518 | B2 | 10/2005 | Solheim et al. | |
| 7,083,525 | B2 | 8/2006 | Pond et al. | |
| 7,112,147 | B2 | 9/2006 | Solheim et al. | |
| 7,169,057 | B2 | 1/2007 | Wood et al. | |
| 2004/0092331 | A1 * | 5/2004 | Best | 473/332 |
| 2005/0202899 | A1 * | 9/2005 | Roach et al. | 473/332 |
| 2005/0245325 | A1 | 11/2005 | Gilbert et al. | |
| 2006/0258480 | A1 * | 11/2006 | Hou et al. | 473/332 |
| 2007/0026964 | A1 | 2/2007 | Jones et al. | |

* cited by examiner

*Primary Examiner*—Gene Kim
*Assistant Examiner*—Matthew B Stanczak
(74) *Attorney, Agent, or Firm*—Knobbe, Martens, Olson & Bear, LLP

(57) ABSTRACT

A golf club head having a cavity back design with a cavity therein for placement of lightweight dual-durometer silicone. The club head is prepared by brushing an adhesive onto the interior wall, but omitting a pre-selected area of the wall to allow silicone to shrink away at the omitted area to allow for control of the shrinkage. A first shot of 80 Shore A silicone is placed into the cavity and disposed against the interior wall. Next, a softer 50 Shore A silicone is juxtaposed against the first shot of silicone and it is pressed using a hot mold finishing tool wherein a substantial portion of the cavity is filled. A polycarbonate insert is attached to an outer surface of the second silicone to provide a zero gap appearance. A tan delta ratio of the first silicone to the second silicone is greater than 1.6. A storage modulus of the first silicone is at least three times greater than the second silicone. And, a loss modulus of the first silicone is at least ten times the second silicone.

19 Claims, 2 Drawing Sheets

CAVITY BACK GOLF CLUB HEAD

FIELD OF THE INVENTION

The present invention generally relates to golf clubs and, more particularly to cavity back irons filled with hot molded dual durometer silicone for use as a damping material.

BACKGROUND OF THE INVENTION

The individual golf club heads in a set typically increase progressively in strike face surface area and weight as the clubs progress from the long irons to the short irons. Therefore, the club heads of the long irons have a smaller strike face surface area than the short irons and are typically more difficult for the average golfer to hit consistently well. For conventional club heads, this arises at least in part due to the smaller sweet spot of the corresponding smaller strike face.

To help the average golfer consistently hit the sweet spot of a club head, many golf clubs are available having heads with so-called cavity back designs with increased perimeter weighting. Another more recent trend has been to simply increase the overall size of the club heads, especially in the long irons. Each of these features will increase the size of the sweet spot and therefore make it more likely that a shot hit slightly off the center of gravity of the club head still makes contact with the sweet spot and flies farther and straighter as a result. One challenge the golf club designer faces is maintaining a desirable and effective overall weight of the golf club when maximizing the size of the club head. For example, if the club head of a three iron is increased in size and weight, the club may become difficult for the average golfer to properly swing.

Another problem area for the average golfer is that of excess vibration resulting from an off center impact with the golf ball. Various types of vibration dampening have been incorporated into club heads to absorb these impact vibrations. However, there is still a need for improvement in the areas of weight redistribution, vibration dampening in golf club heads, and especially improving the sound and feel upon striking the golf ball. A significant need is to provide a golf club head that is more tolerant to a golfer's inadvertent misplacement of the front hitting surface upon contact with the ball. In addition to inaccuracy of the shot, vibrations are indicative of a less than ideal transfer of energy from the club to the ball, and consequently represent inefficiency in the club head.

There remains a significant need, therefore, for a golf club head that is more accurate and more forgiving and which more efficiently dampens the transmission of shock vibrations from the golf club head to the shaft.

SUMMARY OF THE INVENTION

The invention includes a cavity of a golf iron club head that is substantially filled with dual durometer silicone material. This design accomplishes several things. First, it allows the head to have a larger volume for a given amount of weight, in that the silicone material adds very little weight to the iron club head relative to the volume added. Secondly, it provides for attaching a polycarbonate insert to the silicone. And thirdly, it creates a method for efficiently dampening undesirable vibrations.

The cavity for the insertion of the silicone is preferably formed in the main body structure of the golf club head during the casting or forging process, but may also be formed subsequently by machining. Because the silicone that fills the cavity is less dense than the metal material that would have filled the cavity, the mass moment of inertia of the golf club is actually increased.

The golf club head of the present invention comprises a body portion that is preferably made of stainless steel and which has a cavity defined therein, wherein a first silicone having a high durometer hardness and a second silicone comprising of a lower hardness durometer substantially fills the cavity. The first silicone is disposed into the cavity as a hot molded cured silicone material having Shore A hardness of about 70 to 80, and the material is placed into the cavity so as to be contiguous against the interior surface of the body. The second silicone, having a hardness of abut 40-50, is then disposed into the cavity so as to be juxtaposed against the outer boundary of the first material. A polycarbonate insert is attached to the second silicone material by means of a tongue and groove fit and glue adhesive so as to provide a zero gap appearance. By a combination of tape and glue a medallion is then affixed to the insert.

The first silicone is attached to the interior wall by an adhesive that is brushed on the surface. However, an important design concept is the omission of adhesive on the interior surface around area where the sole and bottom face are formed. This allows the relatively hard first silicone to shrink and expand in the no-adhesive zone rather than on the exposed side where the softer second silicone is placed. This reduction of shrinkage at the outer part of the first silicone reduces the amount of "peeling" between the two silicones, which happens when the material pulls away from the walls.

DETAILED DESCRIPTION OF THE PREFERRED EMBODIMENTS

Figure 1:
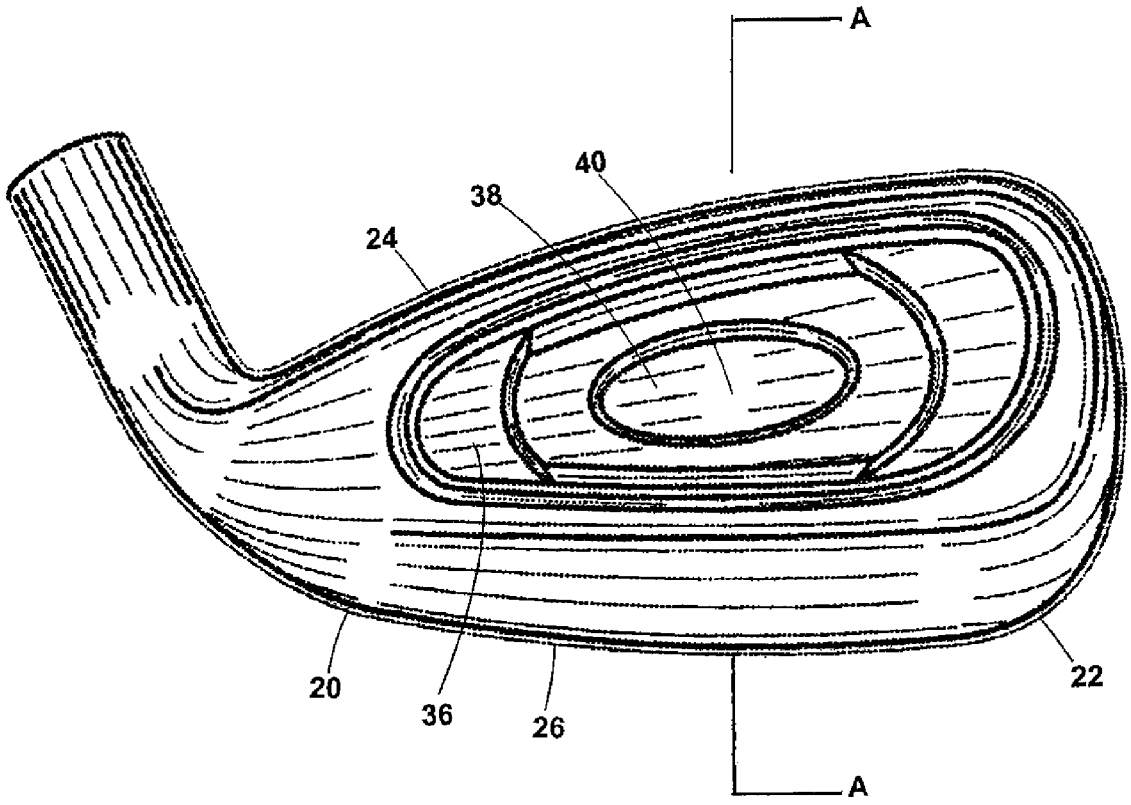
FIG. 1 is a perspective view of the back of a cast steel golf club head body according to our new design.
Figure 2:
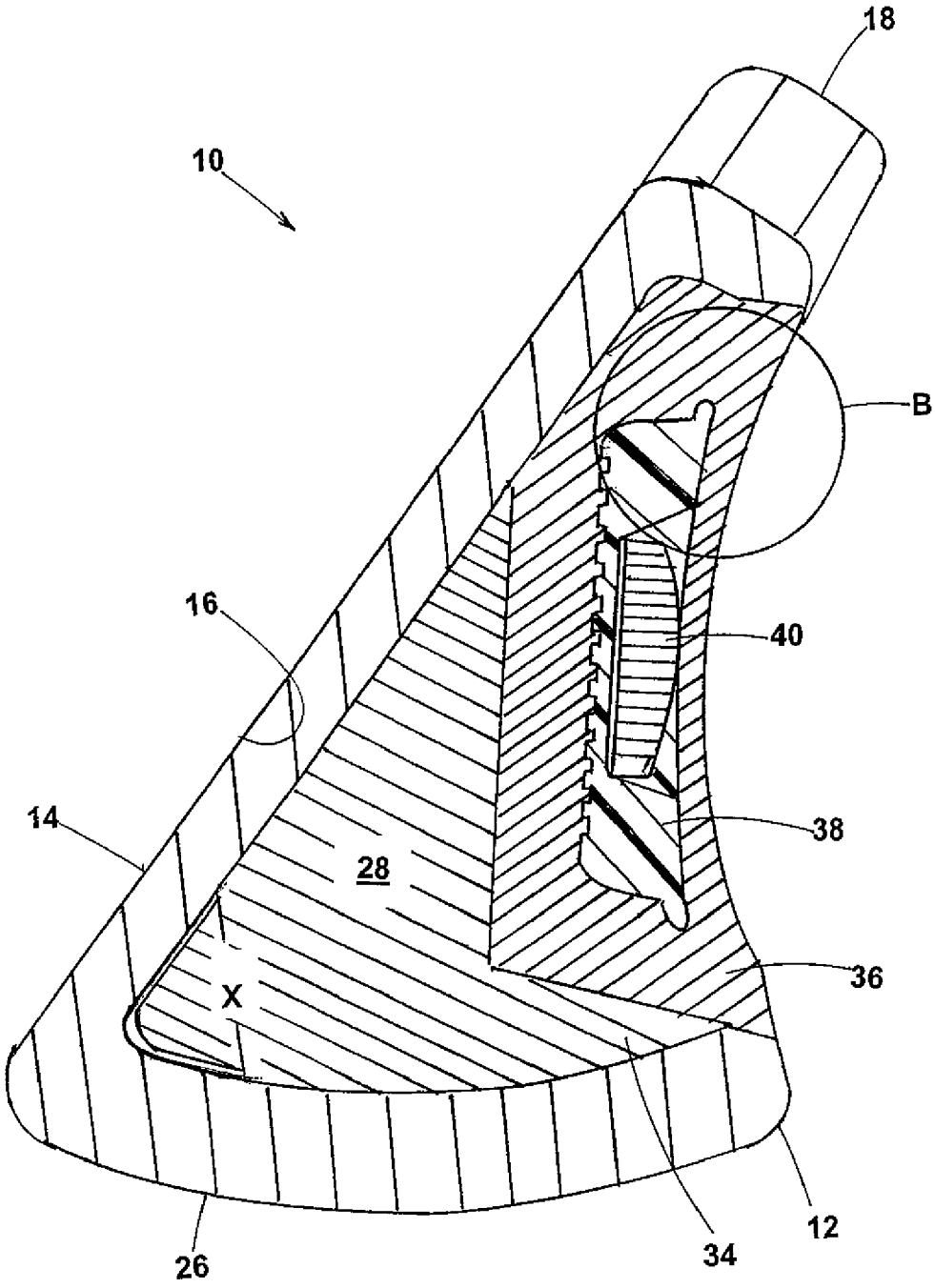
FIG. 2 is a cross-sectional view taken along line A-A of FIG. 1.

Referring to FIGS. 1-2, golf club head 10 is constructed in accordance with a preferred embodiment of this invention. It includes a cavity back body 12, preferably cast, having a front face 14, interior surface 16, a hosel portion 18, a heel portion 20, a toe portion 22, an upper edge 24 and lower edge 26. The body 12 includes a cavity 28 that is defined by the interior surface 16.

In the preferred embodiment, the cavity 28 is preferably formed in the body 12 during the casting process, but may also be formed subsequently by machining. Cavity 28 is substantially filled with a hot molded silicone. The hot molded silicone is disposed into the cavity 28 in two separate shots. The first shot is of a precise pre-cut amount of relatively hard hot molded silicone 34, which when disposed is contiguous to a substantial portion of the interior surface 16 of the body 12. The first silicone has a Shore A hardness between about 70 to 80, preferably 80, which in addition to shrinking less than a softer silicone, provides a stiff support for the second shot of silicone 36. The second shot of silicone has a Shore A hardness of about 40-50, preferably about 50, and juxtaposes against the outer surface of the first silicone 34.

Prior to inserting any silicone, the rear surface 16 of the body is prepared by an adhesive that is brushed on the surface 16, with the exception that the adhesive is omitted on the lower front region designated as a no-adhesive zone X in FIG. 2. This is a critical design concept of the invention, as it allows the relatively hard first silicone 34 to shrink and expand in the no-adhesive zone X region rather than on the exposed side where the softer second silicone 36 is placed. This reduction of shrinkage at the outer part of the first silicone 34 reduces the amount of "peeling" between the two silicones 34, 36, which happens if the material pulls away from the walls. The employment of the harder 80 A first silicone 34 accomplishes two things: first, there is less shrinkage than there would be with a softer silicone, and secondly, when combining the dual durometer silicones 34, 36, a superior damping effect is obtained than that which would be expected by a one hardness silicone.

The softer second silicone 36 has a highly durable polycarbonate insert 38 attached to it by means of a tongue and groove fit as shown in detail B. The insert 38 provides a zero gap appearance for the back view of the club head and may be bound to the second silicone 36 by a glue adhesive. An decorative oval medallion 40 is placed into a pocket of the polycarbonate insert 38 with a combination of tape and glue, the medallion 40 having a logo or some form of indicia on its outer wall. The adhesives and glue are commercially available and well known to those skilled in the art.

The present invention creates a vibration dampening golf club that also absorbs some of the impact noise. Since the hot molded dual durometer silicones 34, 36, are less dense than the metal material that would have filled the cavity 28, the mass moment of inertia of the golf club head 10 is increased. Substituting lightweight silicone, in lieu of a denser metal material, allows for the club head 10 to be larger without increasing its overall weight. Preferably, the silicone material has a density of about 1.2 grams/cc. This provides for an iron to have a larger sweet spot and thereby inherently making it easier to hit.

The use of silicone is restricted to the shorter irons (8, 9, pitching wedge, sand wedge), while the 6 and 7 irons, and hybrid or utility clubs complete the golf club set. Principles of the present invention can be seen employed in the King Cobra TRANSITION-S™ model irons which are also depicted in co-pending and commonly owned Design Pat. Application No. 29/1278,316, which is incorporated herein, in is entirety by reference thereof. For a typical set of the King Cobra TRANSITION-S™ irons, the following chart indicates the amounts of steel, silicone, and polycarbonate that comprise each club head.

| Loft # | Top of Hosel Volume (cc) | 431 Steel Volume (cc) | Silicone Volume (cc) | Polycarbonate Volume (cc) |
|---|---|---|---|---|
| 3 | 101 | na | na | na |
| 4 | 98 | na | na | na |
| 5 | 96 | na | na | na |
| 6 | 70 | na | na | na |
| 7 | 70 | na | na | na |
| 8 | 59 | 33 | 24 | 2 |
| 9 | 59 | 34 | 23 | 2 |
| PW | 58 | 36 | 21 | 2 |
| SW | 65 | 35 | 29 | 1 |

Silicone Density = 1.2 gms/cc
Polycarbonate (Medallion) Density = 1.1 gms/cc
431 Stainless Steel Density = 7.75 gms/cc DMA measurements using the tension mode of the DMA are quite helpful in establishing tan delta, storage and loss modulus of the two silicones 34, 36. Hardness is similar to a complex modulus, which is separated as storage and loss modulus. Storage modulus is the resilient component of stiffness, and loss modulus is the dampening component of stiffness. Tan delta is computed from the ratio of loss of modulus divided by the storage modulus and the smaller the tan delta ratio, the more viscous the material.

The tables below depict some of the values that are desirable when discussing the relationship between the two silicones of varying Shore A hardness.

DMA Tan Delta First Silicone Material (80 A) (@ Ambient Temperature)

| Amplitude (microns) | 1 Hz | 10 Hz | 50 Hz |
|---|---|---|---|
| 25 | 0.08 | 0.09 | 0.10 |
| 50 | 0.10 | 0.10 | 0.12 |
| 100 | 0.11 | 0.12 | 0.14 |

DMA Tan Delta Second Silicone Material (50 A) (@ Ambient Temperature)

| Amplitude (microns) | 1 Hz | 10 Hz | 50 Hz |
|---|---|---|---|
| 25 | 0.04 | 0.04 | 0.06 |
| 50 | 0.04 | 0.04 | 0.06 |
| 100 | 0.04 | 0.05 | 0.06 |

| DMA 1 Hz Frequency 100 Micron Amplitude | Storage Modulus @ Ambient Temperature (MPa) | Loss Modulus @ Ambient Temperature (MPa) |
|---|---|---|
| First Silicone (80 A) | 14.4 | 1.5 |
| Second Silicone (50 A) | 2.5 | 0.1 |

The above results were conducted by using the tension mode of a DMA (Dynamic Mechanical Analysis) instrument manufactured by TA Instruments, Inc. of New Castle, Del. The tan delta, storage modulus and loss modulus were obtained by taking a sample of the silicone materials and cutting to about 3 mm thick by 9 mm wide and about 24 mm of lengths. The length section is placed between the tension mode clamps of a Model 2980 DMA instrument. The DMA is operated with the oven in the up/open position and the sample is equilibrated to room temperature (about 23.0±2.0° C.). The instrument was set to frequencies of 1, 10, and 50 Hz and incremented in amplitude to 25, 50 and 100 microns for each frequency. A static force of 1.5N is applied to the clamped sample.

In accordance with the present invention, it will be appreciated that various aspects of the invention, as well as combinations thereof provide a golf club with an improved manner of redistributing weight from central portions of the golf club to perimeter portions of the club head, thereby increasing the face area and sweet spot without detrimentally altering overall weight or handling characteristics of the club. While various descriptions of the present invention are described above, it is understood that the various features of the present invention can be used singly or in combination thereof. Therefore, this invention is not to be limited to the specifically preferred embodiments depicted therein.

It is claimed:

1. A golf club head comprising:

a body;

a cavity defined by an interior surface of the body;

a first silicone having a first hardness and disposed contiguously against a substantial portion of a front interior surface therein partially filling the cavity;

a no-adhesive zone created on a lower front portion of the front interior surface to confine shrinkage of the first silicone to that zone;

a second silicone having a second hardness of at least 20 Shore A points lower than the first silicone and juxtaposed against an outer surface of the first silicone therein filling the cavity, and a polycarbonate insert attached to an outer surface of the second silicone to provide a zero gap appearance.

2. The golf club head of claim 1, wherein the first silicone has a Shore A hardness of about 70 to 80 and the second silicone material has a Shore A hardness of about 40 to 50.

3. The golf club head of claim 1, wherein the polycarbonate insert is attached by a tongue and groove fit and held by a glue adhesive.

4. The golf club head of claim 1, further comprising a medallion affixed to the polycarbonate insert.

5. The golf club head of claim 4, wherein the medallion is affixed by tape and glue.

6. The golf club head of claim 1, wherein the tan delta ratio of the first silicone to the second silicone is greater than 1.6.

7. The golf club head of claim 1, wherein the storage modulus of the first silicone is at least three times greater than the second silicone.

8. The golf club head of claim 1 , wherein the loss modulus of the first silicone is at least ten times the second silicone.

9. The golf club head of claim 1, wherein the body portion is constructed from type 431 Stainless Steel having a density of about 7.75 grams per cc.

10. The golf club head of claim 1, wherein the silicone materials have a density no greater than 1.2 grams per cc.

11. The golf club head of claim 1, wherein the volume of silicone is at least 33 percent of the club head volume.

12. The golf club head of claim 1, wherein the club head is cast.

13. A golf club head comprising:

a body;

a cavity defined by an interior surface of the body;

a first silicone having a first hardness and disposed contiguously against a substantial portion of a front interior surface therein partially filling the cavity;

a second silicone having a second hardness of at least 20 Shore A points lower than the first silicone and juxtaposed against the first silicone therein filling the cavity; and a no-adhesive zone created on a lower portion of the front interior surface for allowing shrinkage of the first silicone to be confined to that portion of the club head.

14. The golf club head of claim 13, wherein a polycarbonate insert is attached to an outer surface of the second silicone to provide for a zero gap appearance.

15. The golf club head of claim 14, wherein a medallion is affixed to the polycarbonate insert.

16. The golf club head of claim 13, wherein a tan delta ratio of the first silicone to the second silicone is greater than 1.6.

17. The golf club head of claim 13, wherein the storage modulus of the first silicone is at least three times greater than the second silicone.

18. The golf club head of claim 13, wherein the loss modulus of the first silicone is at least ten times the second silicone.

19. The golf club head of claim 13, wherein the first silicone has a Shore A hardness of about 80 and the second silicone material has a Shore A hardness of about 50.

* * * * *

UNITED STATES PATENT AND TRADEMARK OFFICE

CERTIFICATE OF CORRECTION

PATENT NO. : 7,803,068 B2
APPLICATION NO. : 11/766824
DATED : September 28, 2010
INVENTOR(S) : Clausen et al.

It is certified that error appears in the above-identified patent and that said Letters Patent is hereby corrected as shown below:

In Column 3, Line 39 (approx.), change "29/1278, 316," to --29/278,316,--.

In Column 5, Line 28, in Claim 8, change "claim 1 ," to --claim 1,--.

Signed and Sealed this
Twenty-second Day of March, 2011

David J. Kappos

David J. Kappos
*Director of the United States Patent and Trademark Office*